US010490322B2

(12) United States Patent
Brunner et al.

(10) Patent No.: US 10,490,322 B2
(45) Date of Patent: Nov. 26, 2019

(54) COMPONENT CARRIER HAVING AN ESD PROTECTIVE FUNCTION AND METHOD FOR PRODUCING SAME

(71) Applicant: EPCOS AG, München (DE)

(72) Inventors: Sebastian Brunner, Graz (AT); Christian Faistauer, Frauental (AT); Günter Pudmich, Köflach (AT); Edmund Payr, Graz (AT); Kurt Wiesbauer, Deutschlandsberg (AT)

(73) Assignee: Epcos AG, München (DE)

( * ) Notice: Subject to any disclaimer, the term of this patent is extended or adjusted under 35 U.S.C. 154(b) by 0 days.

(21) Appl. No.: 16/064,809

(22) PCT Filed: Jan. 10, 2017

(86) PCT No.: PCT/EP2017/050409
§ 371 (c)(1),
(2) Date: Jun. 21, 2018

(87) PCT Pub. No.: WO2017/121727
PCT Pub. Date: Jul. 20, 2017

(65) Prior Publication Data

US 2019/0019604 A1 Jan. 17, 2019

(30) Foreign Application Priority Data

Jan. 11, 2016 (DE) ..... 10 2016 100 352

(51) Int. Cl.
*H01C 1/14* (2006.01)
*H01C 7/10* (2006.01)
(Continued)

(52) U.S. Cl.
CPC ..... *H01C 7/1006* (2013.01); *H01C 1/14* (2013.01); *H01C 1/144* (2013.01); *H01C 7/102* (2013.01);
(Continued)

(58) Field of Classification Search
CPC ..... H01C 7/1006; H01C 1/14; H01C 1/144; H01C 7/102
(Continued)

(56) References Cited

U.S. PATENT DOCUMENTS 5,119,062 A * 6/1992 Nakamura ..... H01C 7/10 338/20
5,699,035 A 12/1997 Ito
(Continued)

FOREIGN PATENT DOCUMENTS

DE 102008024480 A1 12/2009
EP 1111679 A2 6/2001
(Continued)

OTHER PUBLICATIONS

International Search Report in International Patent Application No. PCT/EP2017/050409, dated Mar. 21, 2017 (3 pages).
(Continued)

*Primary Examiner* — Kyung S Lee
*Assistant Examiner* — Iman Malakooti
(74) *Attorney, Agent, or Firm* — Nixon Peabody LLP

(57) ABSTRACT

A green film composed of varistor material laminated on a ceramic main body, which is provided with metallizations on both sides, and is sintered to form a varistor layer. A terminating electrode pair completes the arrangement and allows the varistor layer to be operated as a varistor. The upper second electrode pair can serve directly as a terminal contact for mounting an electrical component.

14 Claims, 6 Drawing Sheets

(51) Int. Cl.
*H01C 1/144* (2006.01)
*H01C 7/102* (2006.01)
*H01C 17/065* (2006.01)
*H01C 17/28* (2006.01)

(52) U.S. Cl.
CPC ..... *H01C 17/065* (2013.01); *H01C 17/281* (2013.01)

(58) Field of Classification Search
USPC ..... 338/21
See application file for complete search history.

(56) References Cited

U.S. PATENT DOCUMENTS 6,608,547 B1* 8/2003 Greier ..... H01C 7/105 338/20
7,768,754 B2 8/2010 Collins
2005/0184387 A1 8/2005 Collins
2007/0271782 A1* 11/2007 Block ..... H01C 1/14 29/843
2008/0238604 A1 10/2008 Sato
2009/0045907 A1* 2/2009 Hoidis ..... H01C 7/1006 338/21
2011/0261536 A1* 10/2011 Feichtinger ..... H01C 1/084 361/713
2013/0335189 A1* 12/2013 Abe ..... H01C 1/014 338/21

FOREIGN PATENT DOCUMENTS

EP 2381451 A1 10/2011
JP 05-072567 A 3/1993
JP 2009-252930 A 10/2009
WO WO 2000/04577 A1 1/2000

OTHER PUBLICATIONS

Written Opinion in International Patent Application No. PCT/EP2017/050409, dated Mar. 21, 2017 (5 pages).

* cited by examiner

COMPONENT CARRIER HAVING AN ESD PROTECTIVE FUNCTION AND METHOD FOR PRODUCING SAME

CROSS-REFERENCE TO RELATED APPLICATIONS

This application is a U.S. National Stage of International Application No. PCT/EP2017/050409, filed Jan. 10, 2017, which claims the benefit of German Patent Application No. 102016100352.2, filed Jan. 11, 2016, both of which are incorporated herein by reference in their entireties.

The application relates to a component carrier having a built-in ESD protective function, which can be equipped with electrical components and in this case provides ESD protection for said components, and to a method for producing same.

Varistors can be used for protecting sensitive installations, components and networks against ESD (electrostatic discharge). Varistors are nonlinear components whose resistance decreases greatly when a specific applied voltage is exceeded. Varistors are therefore suitable for harmlessly dissipating overvoltage pulses. Varistors are produced from a zinc oxide ceramic having a grain structure.

Varistors can be integrated poorly in modular ceramics and are therefore usually used as discrete components.

Discrete components having a varistor function or generally having an ESD protective function are directly soldered onto a ceramic substrate, a leadframe, a circuit board or a printed circuit board and electrically connected to the component to be protected.

It is also possible to integrate such protection elements into a laminate during the production thereof.

Furthermore, it is possible to position the protection element in a cutout of the substrate, of the carrier plate or of the laminate such that it is adjacent to other electrically conductive structures provided for connection to further components. Although this results in a small component height, it requires sufficient placement area.

It is also possible to use a varistor ceramic as a component substrate and to integrate the protective function into the substrate.

It is an object of the present invention to further improve the integration of a protective function or of a protection element into a component carrier and in particular to provide a component carrier of smaller design. A further partial object consists in specifying a main body having a protective function and an improved thermal conductivity.

This object is achieved by means of a component carrier having the features of claim 1. Advantageous configurations of the invention and also a method for producing a component carrier can be gathered from further claims.

The component carrier comprises a ceramic main body having electrical terminal pads on a first surface and a first electrode pair on a second surface. Electrical terminal pads and first electrode pair are electrically connected to one another via plated-through holes. A varistor layer is applied above the first electrode pair. Furthermore, a second electrode pair is applied above the varistor layer and electrically connected in parallel with the first electrode pair. First and second electrode pairs together with the varistor layer arranged therebetween form a varistor and thus, in the case of an overvoltage present at the terminal pads or generally in the case of an ESD pulse, can dissipate the latter harmlessly by way of a short circuit through the varistor layer, with the result that a component mounted onto the second electrode pair or electrically connected to the second electrode pair is not damaged.

The varistor layer abuts flat on the main body, can utilize the first electrode pair thereof as a varistor electrode and therefore takes up only little additional volume. The component carrier therefore has a relatively small volume.

In this case, the varistor layer is laterally dimensioned such that it is circumferentially spaced apart from the edges of the component carrier. This has the advantage that no side edge of the varistor layer terminates at a side surface of the component carrier. As a result, the varistor layer, after the mounting of the component, is protected against mechanical and other influences.

Such a lateral structuring of the varistor layer has the advantage in particular during the structuring of the main body, or during the singulation of individual component carriers along separating lines, that the separating lines are located outside the varistor layer, with the result that the latter need not be severed during singulation and therefore cannot actually be damaged in the process.

The second electrode pair preferably comprises a solderable material or is provided with a solderable surface layer. An electrical component can then be directly soldered onto the varistor layer or the second "upper" electrode pair thereof. It is not necessary to provide additional terminal pads for such a component. Moreover, the varistor is mechanically protected between component and main body. For the varistor, therefore, a protective layer or a passivation either is not necessary at all or can be produced in a simple and cost-effective embodiment.

The component carrier is suitable for components which generate heat loss during operation. Said heat loss can be dissipated from the component via the component carrier. In this case, the main body advantageously comprises aluminum nitride. The latter is distinguished by a particularly good thermal conductivity. In the case of heat-generating components, this advantage can compensate for the disadvantage of the higher material price. However, other ceramic materials are also suitable for the main body, for example aluminum oxide, silicon carbide, boron nitride or others.

The heat dissipation can also be improved by means of other measures. In this regard, the component carrier can be provided with thermal vias that improve the heat transfer through the main body. The thermal vias are preferably connected to a heat sink that can be provided for example on a circuit board onto which the component carrier is bonded.

In one embodiment, at least the second electrode pair comprises a copper-containing material. In order to produce the electrode pair, copper-containing and silver-containing electrode pastes can be printed which with additional finish yield a solderable surface. However, other electrode pastes are also known onto which soldering can already be effected directly without additional finish.

In one embodiment, at least one internal electrode is arranged between first and second electrode pairs, said at least one internal electrode being embedded into the varistor layer in an electrically floating fashion or being electrically connected to a respective electrode of the first electrode pair. This has the advantage during production that a greater tolerance is acceptable since, even with poorer mutual geometric orientation, all that changes is the volume of the active varistor region and thus the capacitance thereof. What matters for the magnitude of the varistor voltage is the smallest distance between the electrodes and thus the smallest number of transitions through which harmful overvoltages are dissipated harmlessly as a short circuit within the varistor. A higher volume leads to a higher current endurance, such that higher currents can thus be dissipated.

A floating internal electrode has the advantage of voltage division, such that the voltage present between an electrode pair and the internal electrode is halved as a result. The varistor voltage at which the current dissipation via the varistor commences is then correspondingly lower and can be obtained with correspondingly thinner varistor layers. An electrically connected internal electrode enlarges the varistor area and thus improves the current dissipation in the case of an overvoltage or an ESD pulse.

In a further embodiment, a passivation layer is arranged above the varistor layer and the second electrode pair such that the varistor layer is enclosed on all sides and completely between main body, second electrode pair and passivation layer and only terminal contacts remain free of and not covered by the second electrode pair. The passivation layer can be applied and structured after the varistor layer has been applied. The second electrode pair can then be produced in surface regions that are free of the passivation layer.

It is also possible to produce the passivation layer after the second electrode pair has been produced. Terminal contacts for the mounting of the component can then be produced in surface regions that are free of the passivation layer.

A method according to the invention for producing a component carrier comprises the following steps:

a) providing a monolithic ceramic main body,
b) providing plated-through holes through the main body,
c) printing electrical terminal pads on a first surface of the main body,
d) printing a first electrode pair on the second surface,
e) laminating a green film over the whole area above the first electrode pair, said green film being able to be converted into a varistor layer by sintering,
f) structuring the green film such that a circumferential marginal region of the second surface of the main body is also exposed besides an access to the first electrode pair,
g) sintering the green film and converting into the varistor layer,
h) printing a second electrode pair onto the varistor layer and the exposed region of the first electrode pair such that first and second electrode pairs are electrically interconnected and an overlap of an electrode of the first electrode pair with the opposite electrode of the second electrode pair jointly defines an active varistor region situated therebetween.

Method steps a) to d) can substantially follow corresponding known methods without modification.

In step e), the varistor layer is then used as a green film. This can be effected before or after the firing of the printed first electrode pair. The electrode paste thereof can comprise glass components for better adhesion and thus simultaneously also serve as an adhesion promoter for the varistor layer.

The green film for the varistor layer can be laminated onto the main body over the whole area. In this case, the main body can be a ceramic wafer on which a multiplicity of individual carriers can be produced and processed to completion in parallel before the wafer is then singulated into the individual carriers.

If the varistor is embodied with an internal electrode, the latter can be applied on the green film before laminating. However, a mutual orientation between the varistor layer with the internal electrode and the main body with the first electrode pair is then necessary. This is obviated when the the internal electrode is produced after laminating. It is possible, but not necessary, to fire or to sinter individual or more layers after laminating or printing before the next layer is applied.

It is also possible, however, to fabricate a separate prelaminate from at least two or more varistor layers/green films and the at least one internal electrode embedded therein, which prelaminate indeed already has the required cohesion of the layers/films, but itself is also still laminatable or can be laminated onto the main body.

In all cases, the laminated green film is structured such that a circumferential marginal region of the second surface of the main body is also exposed besides an access to the first electrode pair. The structuring can be carried out rapidly and structurally accurately using a laser.

The metallizations of the component carrier such as terminal pads, first and second electrode pairs can be produced by printing a paste containing Cu and glass portions, which has a solderable surface after firing. A paste containing only Cu as metal besides glass components can be provided with a finishing coating, a so-called finish, and thus with a solderable surface. Such a finish can contain Ni, Au, Pt, Pd or Sn.

The internal electrode can be printed just like the other metallizations. This can be effected on an already laminated green film with varistor material or on the separate, not yet laminated green film. A green film provided with an internal electrode can also be printed over the whole area on a large-area main body and not be structured until later. In this case, the internal electrode is oriented toward the first electrode pair. The orientation is less critical if the internal electrode is electrically floating. If the at least one internal electrode is connected to an electrode, then the orientation of the internal electrode toward the first electrode pair has to be effected with lower tolerance. In that case the structuring of the green film should also be carried out such that the internal electrodes to be interconnected with identical polarity are cut at a respective structure edge of the green film or of the green film stack and can be connected to the second electrode pair later.

After laminating the green film, before or after printing the second electrode pair, a passivation layer can be applied and structured such that in the first case only the surface region provided for the second electrode pair remains free of the passivation layer. In the second case the printed second electrode pair remains free of the passivation layer only in such a region in which solderable terminal contacts are subsequently produced by reinforcement of the second electrode pair.

The passivation layer can comprise a glass, ceramic or other dielectric oxides, nitrides, carbides or a polymer such as e.g. polyimide. A polymer can be selected such that it withstands further method steps such as e.g. electroplating, the firing of printed metallizations or soldering processes.

The passivation layer is usually provided to remain on the component carrier even when the latter is equipped with a component and, for its part, incorporated into a circuit environment such as e.g. a circuit board.

The solderable terminal contacts are produced by electrodeposition of the second electrode pair on the exposed region thereof. This reinforcement can simultaneously constitute a solderable metal layer.

It is possible, as stated, for a large-area main body to be provided and singulated later into a multiplicity of component carriers. The separation of the main body is effected exclusively in the marginal region and thus at a distance from the respective edge of the varistor layer. The singulation can be effected in a simple manner e.g. by sawing.

The component carrier according to the invention and various method variants for producing it are explained in greater detail below on the basis of exemplary embodiments and with reference to the associated figures. The figures show schematic cross sections and are not drawn as true to scale. Individual parts may be illustrated in an enlarged manner in order to afford better understanding.

Figure 1:
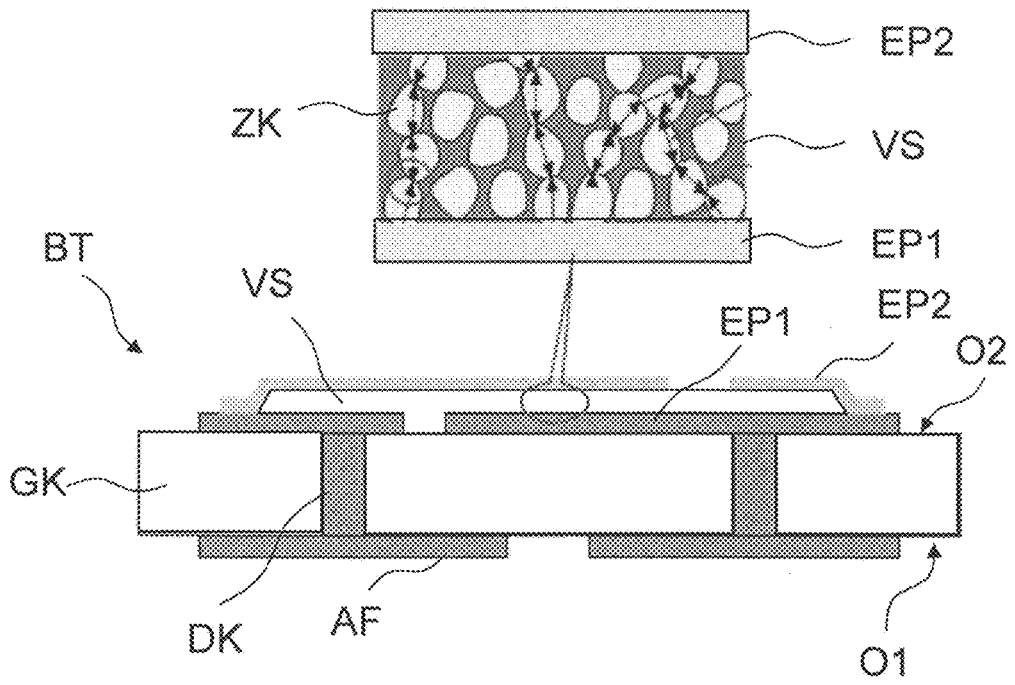
FIG. 1 shows one simple embodiment of a component carrier.

FIG. 1 shows, in schematic cross section, one simple embodiment of a component carrier BT according to the invention. A ceramic main body GK is provided with terminal pads AF on a first surface O1. A first electrode pair EP1 is applied on the second surface O2 situated opposite. Each terminal pad AF is assigned to an electrode of the first electrode pair EP1 and is connected to said electrode via a plated-through hole DK through the main body GK.

A varistor layer VS bears above both electrodes of the first electrode pair EP1. A second electrode pair EP2 is fitted above the varistor layer VS and structured such that a first electrode of the second electrode pair is in contact with a first electrode of the first electrode pair. Correspondingly, the second electrode of the second electrode pair EP2 is in contact with the second electrode of the first electrode pair EP1.

In this case, an electrode of the first electrode pair overlaps an electrode of the second electrode pair EP2 such that with the intervening varistor layer VS in the overlap region a varistor arises.

A part of the active varistor is illustrated as an excerpt in an enlarged view above the component carrier BT. Close-packed zinc oxide grains ZK are arranged in the varistor layer VS. As soon as the voltage present at first and second electrode pairs EP1, EP2 exceeds the breakdown voltage, a conductive path forms between individual zinc oxide grains ZK, with the result that the varistor layer VS becomes conducting and the current is dissipated harmlessly by way of a short circuit through the varistor layer via both electrodes.

The term varistor voltage denotes the voltage drop across the varistor given an impressed current of 1 mA. It does not have special electro-physical importance, but is used as a practical, standardized reference point for specifying varistors.

The main body GK is preferably formed from aluminum oxide or, for better heat conduction, from aluminum nitride. Other ceramic materials, too, are theoretically suitable, but costly. Terminal pads and first electrode pair comprise a fired conductive paste, for example based on silver. The same correspondingly applies to the plated-through hole DK. The second electrode pair EP2, too, is preferably formed from a conductive fired paste and either is already solderable per se or is provided with a solderable surface. A copper-containing paste which either already has a solderable surface per se by virtue of additives or has a solderable surface finish can be used in a cost-effective manner.

Figure 2A:
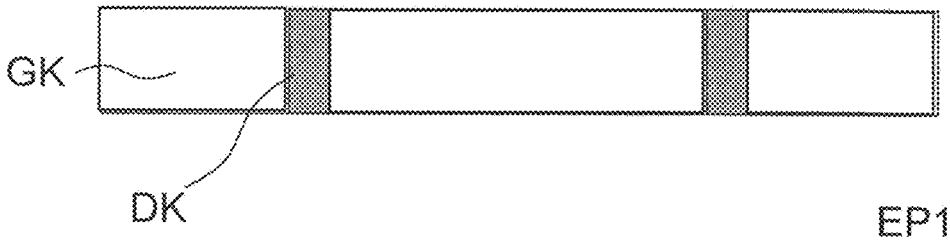
FIGS. 2A to 2H show one simple method for producing a component carrier on the basis of various method stages.

FIGS. 2A to 2H show one simple production method for a component carrier according to FIG. 1. FIG. 2A shows in the first stage a main body GK having, for the purpose of producing plated-through holes DK, at least two holes filled with a conductive compound, in particular a paste that can be fired.

Figure 2B:
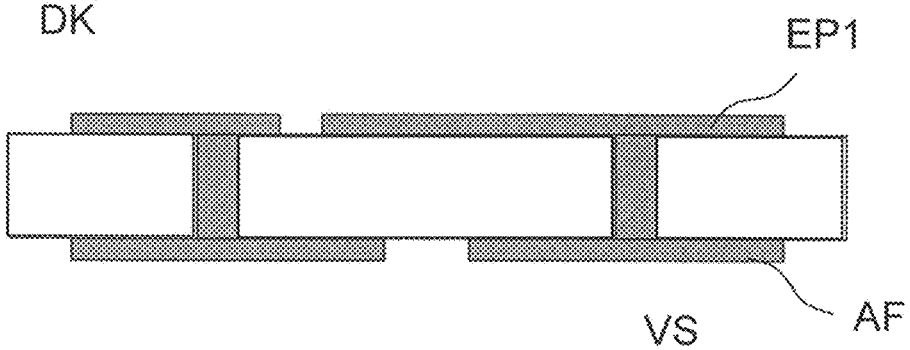
Figure 2C:
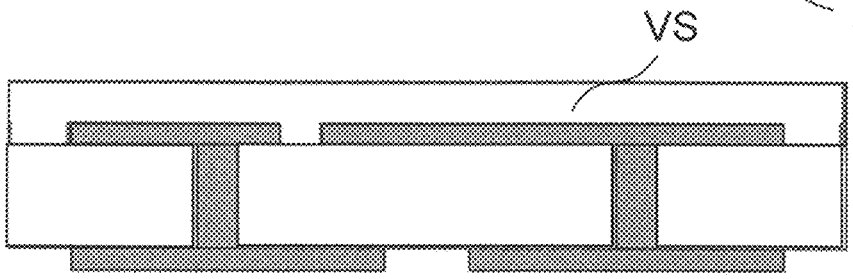

FIG. 2B shows the main body after the production of terminal pads AF on the first surface and a first electrode pair EP1 on the second surface. The metallizations on the two surfaces can be present in the form of a conductive paste, but can also already be fired.

In the next step, a green film of a varistor layer VS is laminated onto the second surface above the first electrode pair EP1. This is carried out over the whole area over the entire surface of the main body GK.

In the next step, the whole-area varistor layer VS is structured with the aid of a structuring tool ST. In this case, the varistor layer VS is removed in a circumferential marginal region along the edges of the main body and the surface of the main body is exposed there. Moreover, the varistor film VS is removed in the marginal region of the first electrode pair EP1 in order to contact the electrode pair there later. Preferably, the electrodes of the first electrode pair are embodied in each case in a strip-shaped fashion, as is the exposed region.

Figure 2D:
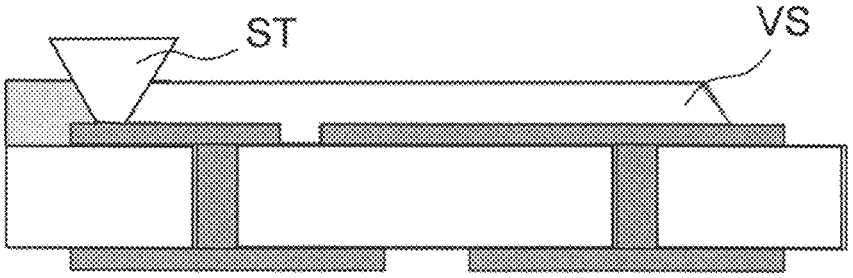
Figure 2E:
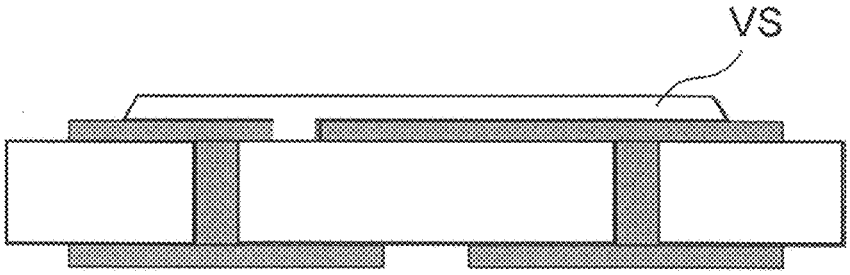

FIG. 2E shows the arrangement after the structuring of the varistor layer VS.

Figure 2F:
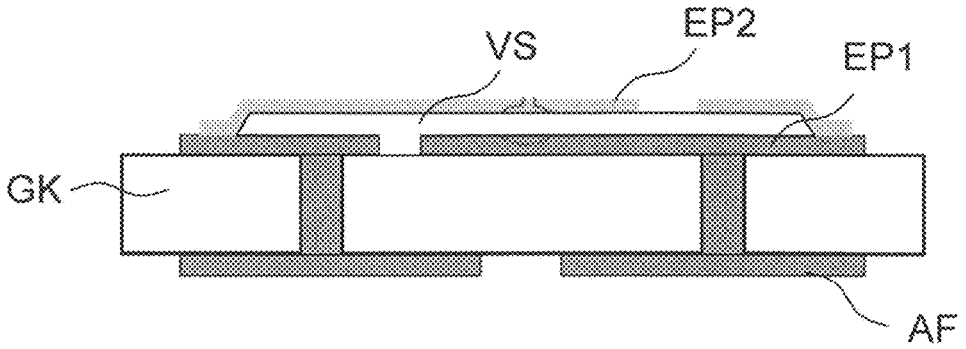

A second electrode pair EP2 is then applied to the laminated green film of the varistor layer VS such that a respective electrode thereof contacts an electrode of the first electrode pair EP1 in the exposed region. The second electrode pair EP2 is preferably printed, wherein a conductive paste based on silver or copper can be used. After printing, the second electrode pair EP2 can be fired, wherein at the same time the first electrode pair, provided that it is not sintered beforehand, and likewise the terminal pads AF are also concomitantly fired. FIG. 2F shows the arrangement after the completion of the second electrode pair.

Figure 2G:
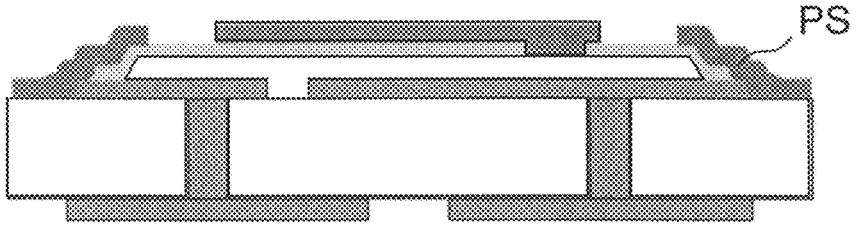

In order to produce solderable terminal contacts AK, a passivation layer PS is then applied over the entire surface and structured such that it forms a mask for the production of the terminal contacts AK. A glass-containing layer or some other resist mask, for example a polymer, can be used as passivation layer PS. A glass-containing passivation layer can be printed, for example. A polymer layer, like a photoresist, can be laminated as a film or applied by spin-coating in liquid form and patterned photolitho-graphically. FIG. 2G shows the arrangement at this method stage.

Figure 2H:
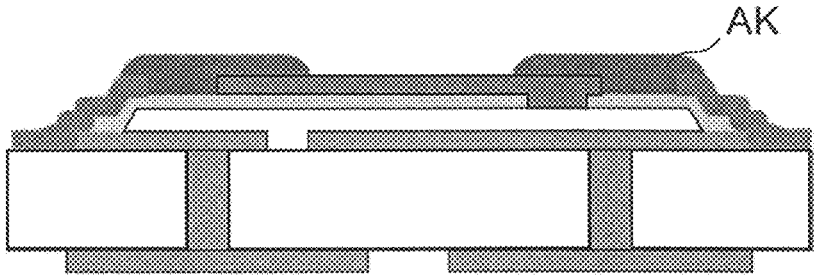

The external contacts AK can then be applied in an galvanic method. To that end, the second electrode pair EP2, where it is freed of and not covered by the passivation layer PS, is reinforced with a metal of good conductivity, for example with copper. In order to produce a solderable surface, a finishing layer composed of gold, palladium or nickel and/or NiPdAu, NiAu or else CuNiSn can subsequently be applied. Together with this finishing step, if appropriate, the terminal pads AF on the first surface O1 can also be provided with a solderable coating. FIG. 2H shows the arrangement at this method stage.

FIGS. 3A to 3F show, on the basis of schematic cross sections during various method stages, the production of a component carrier according to the invention in which an internal electrode IE is provided in the varistor layer VS. The method starts with a main body GK provided with electrodes, for example as illustrated in FIG. 2B. A green film for the varistor layer VS is then laminated onto said main body. In this case, two variants are possible, in principle. In the case of the first variant, a first partial layer of the varistor layer can be laminated and the internal electrode IE can then be printed. Afterward, a second green film of the varistor layer VS is laminated thereabove over the whole area such that the internal electrode is completely embedded between the two varistor layers.

In accordance with a second variant, the internal electrode IE is printed onto a first partial film of the varistor layer VS and then a second partial film of the varistor layer is laminated thereabove. This takes place wholly separately from the main body GK, thus giving rise to a prelaminate, which only then is laminated onto the ceramic main body GK.

Figure 3A:
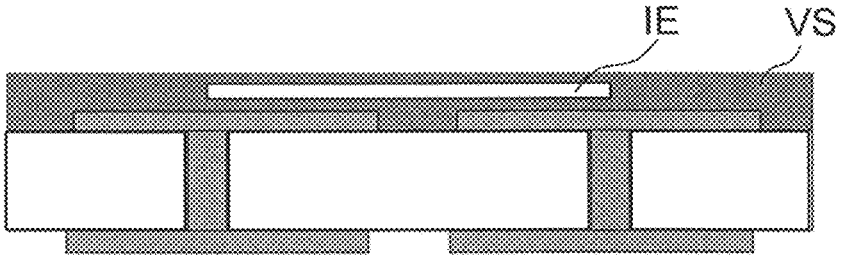
FIGS. 3A to 3F show a second production method for a flat variant on the basis of schematic cross sections during various method stages.

FIG. 3A shows the arrangement with the varistor layer, in which the internal electrode IE is embedded in a manner both overlapping the electrodes of first and second electrode pairs.

Figure 3B:
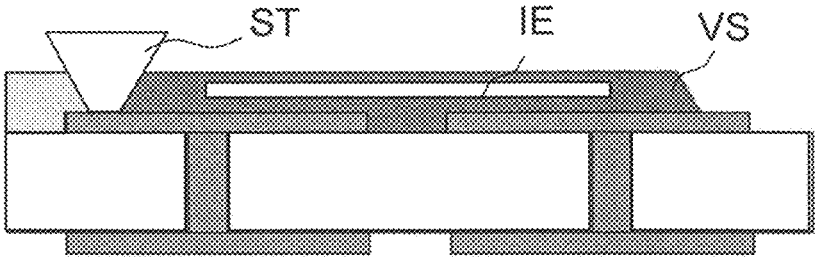

With the aid of a structuring tool ST, as illustrated in FIG. 3B, said varistor layer VS is also structured and in this case the marginal region and likewise the regions of the first electrode pair that are provided for terminals are freed of the varistor layer VS. The internal electrode remains floating and is not exposed or cut during the structuring. By way of example, a laser can be used for the structuring.

Figure 3C:
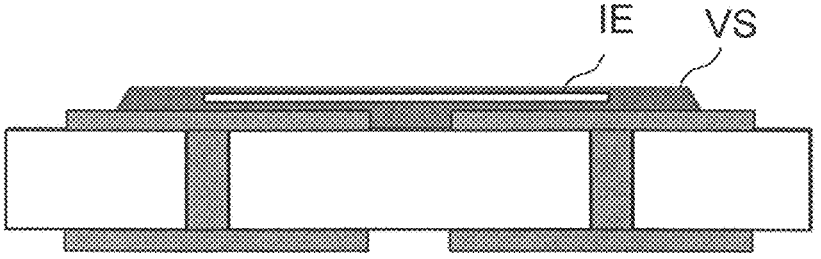

The varistor layer VS is subsequently sintered, wherein a volume shrinkage commences such as occurs when any ceramic is fired. Since the varistor layer is clamped by the main body, however, this leads at most to little lateral shrinkage, usually none at all, but in return to a reduction of the layer thickness of the varistor layer. FIG. 3C shows the arrangement after the sintering of the varistor layer VS, wherein the reduced layer thickness in comparison with FIG. 3B is clearly discernible.

Figure 3D:
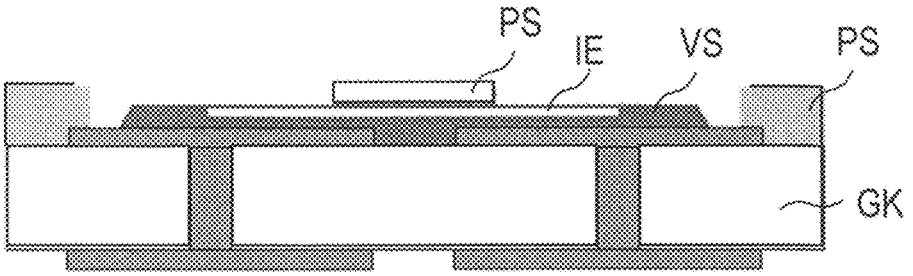

Over the whole area a passivation layer PS is then applied and structured, or is applied in a manner having already been structured or prestructured, for example by printing. The passivation layer PS does not cover the terminal regions provided for connecting the first electrode pair and also parts of the varistor layer VS on which the second electrode pair is produced in a structured fashion later. FIG. 3D shows the arrangement with the structured passivation layer PS.

Figure 3E:
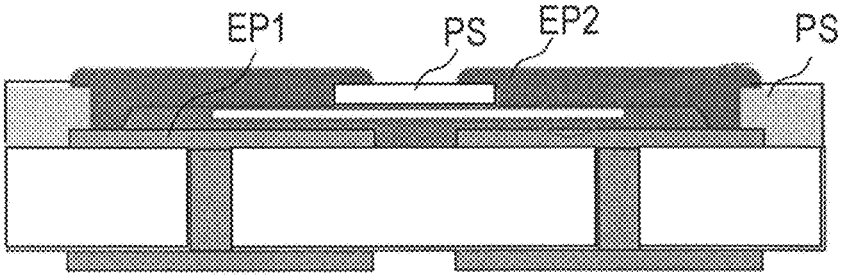

In the regions free of the passivation layer PS, the second electrode pair EP2 is then applied, for example by printing. The second electrode pair is subsequently fired. FIG. 3E shows the arrangement at this method stage.

Figure 3F:
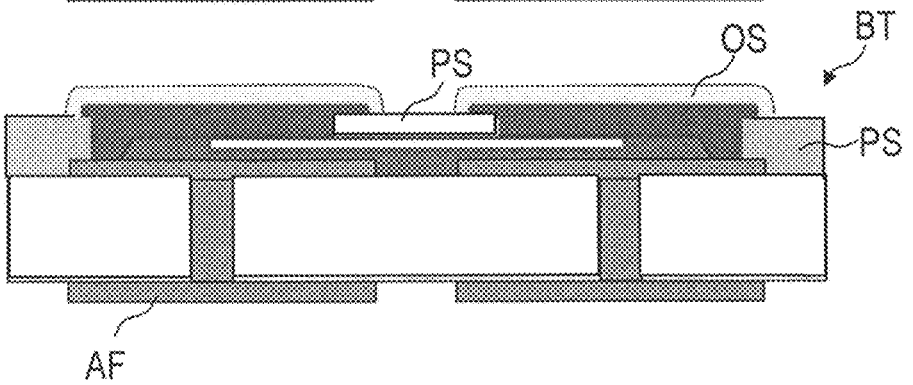

In order to produce a solderable surface, a finishing layer can be applied to the second electrode pair EP2, for example by electrodeposition of a surface layer OS, for example of a gold, palladium or platinum layer, or of one of the further coatings mentioned above. FIG. 3F shows the arrangement at this method stage.

The finished component carrier BT can then be equipped with an electrical component, which can be soldered onto the first electrode pair or onto the surface layer OS thereof. Alternatively, the component can also be mounted onto the terminal pads AF on the opposite first top side O1.

Figure 4A:
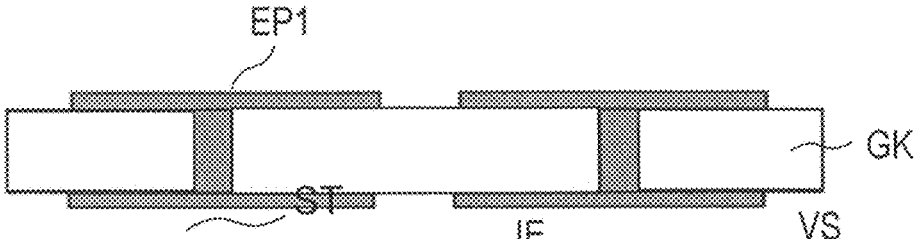
FIGS. 4A to 4G show various method stages on the basis of schematic cross sections during the production of a component carrier comprising a multilayered varistor.

FIGS. 4A to 4G show the production of a component carrier having a multilayered varistor construction on the basis of schematic cross sections during various method stages. To that end, FIG. 4A shows a main body GK coated with electrodes on both sides, namely with terminal pads AF on the underside or first surface and a first electrode pair EP1 on the second surface O2.

A film stack FS is then laminated onto the second surface above the first electrode pair EP1. The method for that can be carried out as already described in the previous exemplary embodiment in accordance with FIG. 3.

Figure 4B:
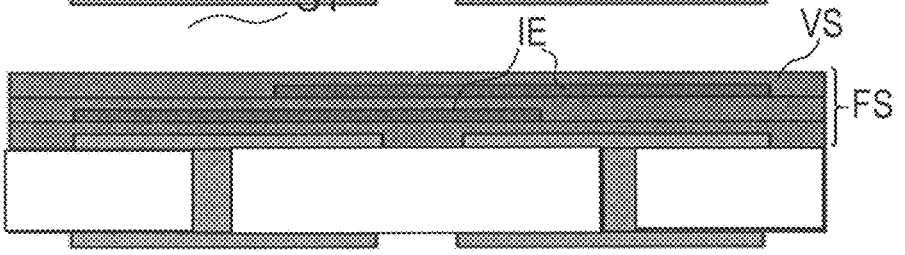
Figure 4C:
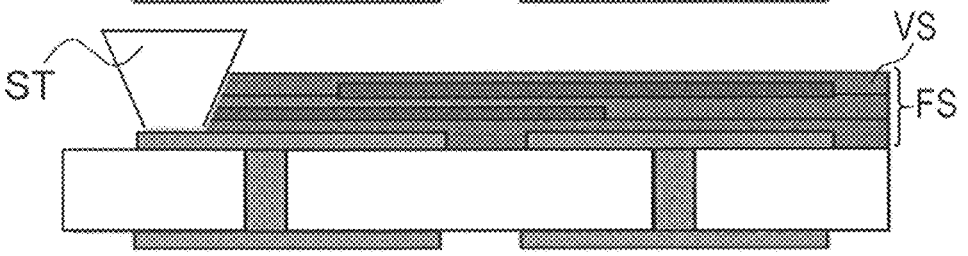

The film stack FS can be produced remotely from the main body by a procedure in which green films printed with electrode material are laminated one above another such that the internal electrodes IE mutually overlap and electrodes of different polarities can be contacted at marginal regions situated opposite one another. There the individual layers of the internal electrodes also do not overlap another internal electrode of opposite polarity. The laminated film stack FS is subsequently laminated as a whole onto the surface of the main body above the first electrode pair EP1. FIG. 4B shows the arrangement at this method stage.

FIG. 2D shows how the film stack FS is structured with the aid of a structuring tool ST such that a circumferential marginal region of the green body and also the terminal regions of the first electrode pair that are provided for connecting the second electrode pair are exposed. At the same time, here in the two opposite marginal regions in each case a corresponding side edge of an internal electrode is exposed in order thus to contact it with an electrode to be applied later of the second electrode pair.

Figure 4D:
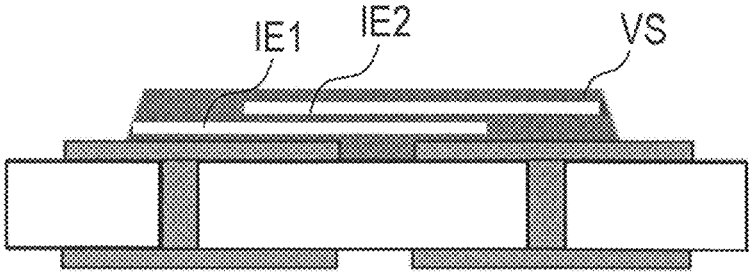

FIG. 4D shows the arrangement after the structuring and firing of the film stack, a varistor layer VS with here two internal electrodes IE being obtained. In the figure, the left edge of the lower internal electrode IE1 is exposed for connection to the left electrode of the first electrode pair. At the right edge of the varistor layer VS, the upper internal electrode 1E2 is exposed for connection to the right electrode of the first electrode pair.

Figure 4E:
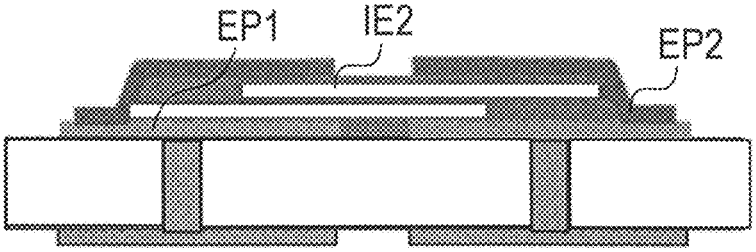

In the next step, the second electrode pair EP2 is printed, wherein each of the two electrodes contacts the corresponding underlying electrode of the first electrode pair 1 and also one or more assigned internal electrodes IE. Besides printing, which is preferred, other metallization methods are also conceivable, in principle, e.g. ink jet methods, vapor deposition, sputtering. In the active varistor region, electrodes of different polarities overlap, selected from electrode layers from the second electrode pair EP2, internal electrodes IE and the first electrode pair EP1. FIG. 4E shows the arrangement at this method stage.

Figure 4F:
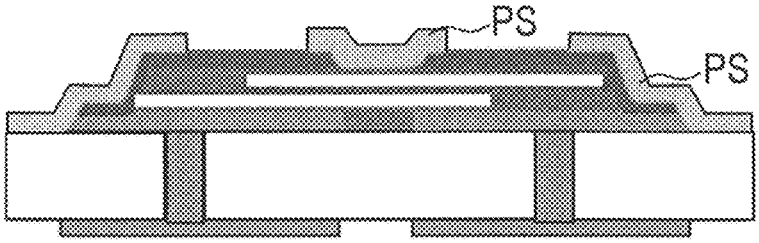
Figure 4G:
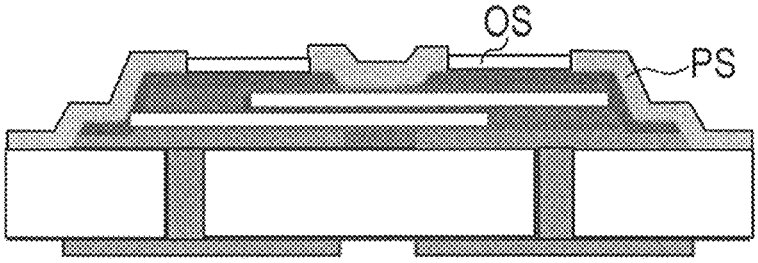

FIG. 4F shows the arrangement after the application of a passivation layer PS, which serves for masking the varistor layer before the production of the terminal contacts. The passivation layer can be printed or else applied by spray coating. As mentioned with reference to the previous exemplary embodiments, the passivation layer can comprise an arbitrary dielectric material, in particular a glass-containing layer or a polymer. The regions of the second electrode pair that are provided for producing the external contacts are left uncovered.

Into these exposed regions, by means of electrodeposition, the second electrode pair EP can then be reinforced or provided with a solderable surface layer OS.

Figure 5A:
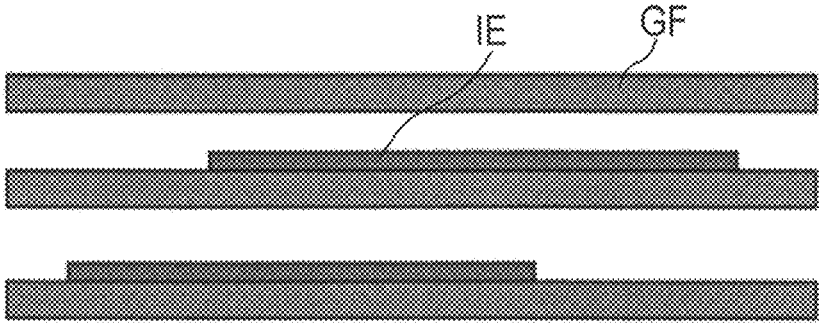
FIGS. 5A and 5B show the production of a film stack such as can be used during the production of a multilayered varistor.
Figure 5B:
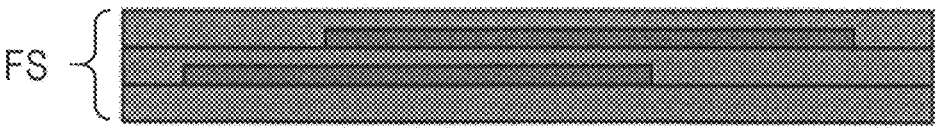

FIGS. 5A and 5B show the production of a film stack FS such as can be used as a prelaminate for a later varistor layer. For this purpose, a corresponding number of green films are printed with an internal electrode and stacked one above another such that internal electrodes IE of different polarities are offset relative to one another, but overlap in the center. An unprinted green film is also arranged above the topmost internal electrode and laminated with the other printed green films to form a film stack FS, as is illustrated in FIG. 5B. The film stack FS, too, can still be handled like a green film and can be laminated in this form onto a green body.

Figure 6E:
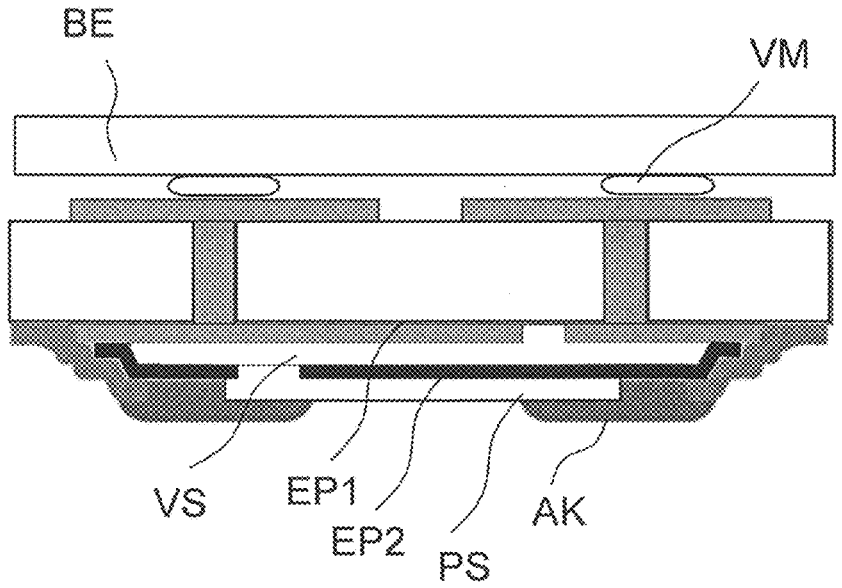
FIGS. 6A to 6E show various embodiments of a component carrier according to the invention after being equipped with a component.
Figure 6A:
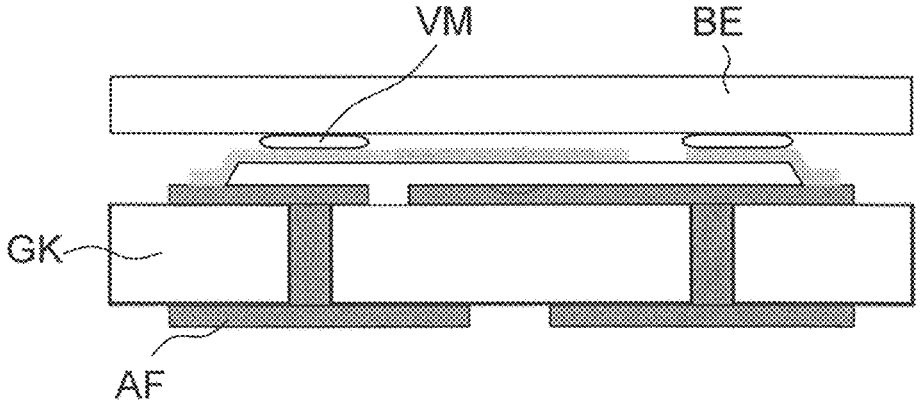

FIGS. 6A to 6E show various embodiments of component carriers according to the invention after the mounting of a component onto the terminal contacts AK of the second electrode pair EP2 or, in the variant in accordance with FIG. 6E, onto the terminal pads AF. FIG. 6A shows the simplest embodiment of the component carrier with monolayer varistor layer and non-passivated second electrode pair.

Figure 6B:
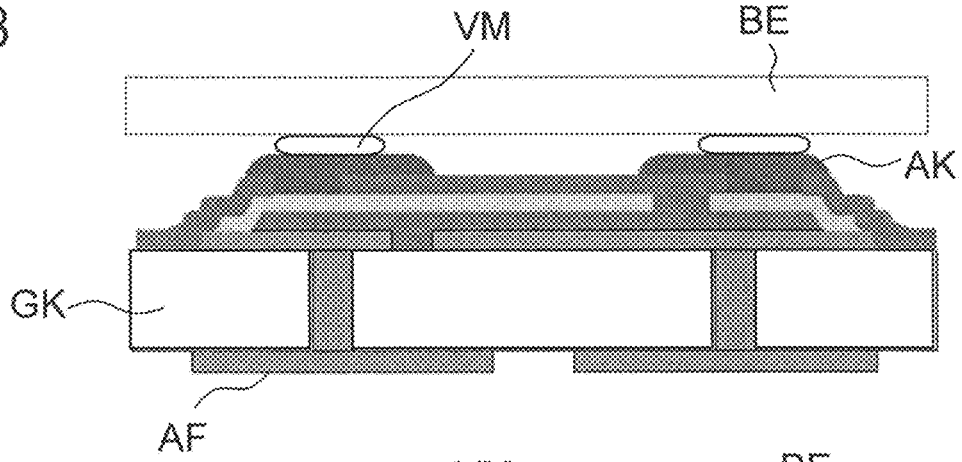

In the embodiment according to FIG. 6B, a monolayer varistor layer VS is likewise used, but exposed regions of the varistor layer and large parts of the second electrode pair EP2 are covered with a passivation layer PS. The only locations that remain free are those in which the terminal contacts are produced, onto which the component BE is subsequently mounted with the aid of connection means VM. A bump or a conventional solder joint can be used as connection means VM.

Figure 6C:
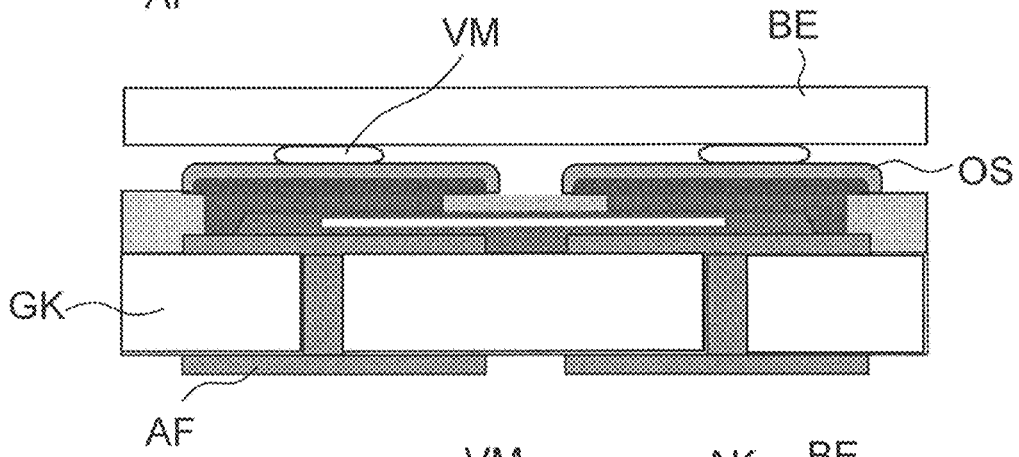

In the embodiment according to FIG. 6C, the varistor layer VS has a floating internal electrode, which is not in electrical contact with first or second electrode pair. Here, too, a passivation layer PS is again provided, which leaves free only the terminal contacts. In contrast to FIG. 6B, a surface layer OS is additionally also applied above the terminal contacts or the second electrode pair EP in the region of the terminal contacts.

Figure 6D:
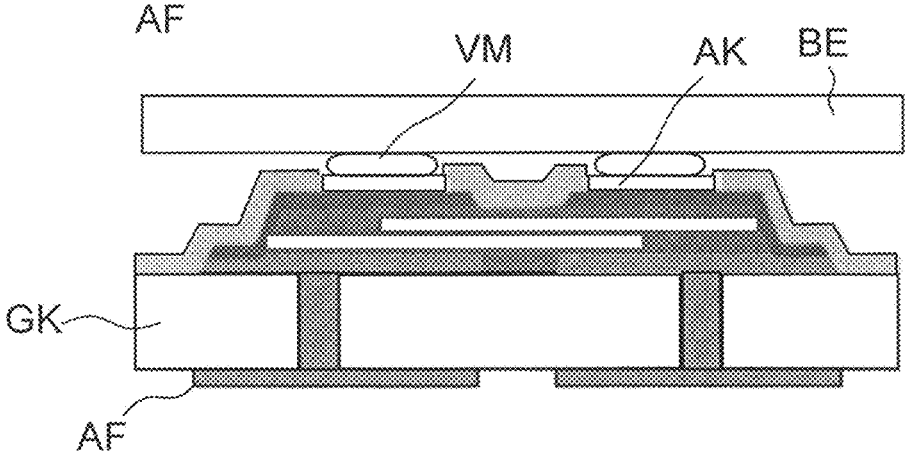

FIG. 6D shows a multilayered varistor layer, in which at least two internal electrodes are provided, which are electrically conductively connected alternately to a respective electrode of the second electrode pair EP. A passivation layer PS above the second electrode pair and the exposed region of the varistor layer leaves free only the region for the terminal contacts AK, which can be produced electrolytically. A component BE is applied to the terminal contacts and electrically conductively connected with the aid of connection means VM.

FIG. 6E shows the already explained embodiment of a component carrier in which the component is applied to the terminal pads on the opposite surface of the main body GK by means of connection means VM. In this method variant, the varistor layer is preferably covered with a passivation layer apart from the external contacts AK in order to facilitate the handling of the component carrier with the component BE mounted thereon, or in order to protect the varistor layer VS during the handling of the arrangement.

The component BE can be an arbitrary electrical component which is sensitive to overvoltages such as can be triggered e.g. by an ESD pulse, and which is protected against these current or voltage surges with the aid of the varistor function within the varistor layer. One exemplary application is an LED that can be applied as component BE to the component carrier.

The invention has been able to be explained only on the basis of a few exemplary embodiments and is therefore not restricted to the embodiments illustrated. The production methods, in particular, have been illustrated only for an isolated main body intended to be equipped with a component. It is also possible, however, to use a large-area main body GK or a corresponding wafer which can be singulated into a multiplicity of individual component carriers in the latter method step.

Although the electrodes have been illustrated only in pairs, a component carrier is not restricted to those having two electrodes or having two terminal contacts per electrode. For each electrode it is possible to provide a plurality of terminal pads or electrode pairs, which, however, can again be interconnected in parallel among one another.

The varistor layer can be without an internal electrode or be provided with a floating internal electrode or with electrically connected overlapping internal electrodes. The number of internal electrodes enlarges the overlap area of electrodes of opposite polarities and thus determines the capacitance of the varistor.

More overlap area of the electrodes leads to more current-carrying capacity. Doubled ceramic height with internal electrode situated therebetween yields doubled protection level since double the number of microvaristors are then in series. Doubled area yields doubled dissipation capability since double the number of current paths are then in parallel.

Doubled volume of the varistor yields approximately doubled energy absorption capability since double the number of energy absorbers in the form of zinc oxide grains are then available.

The embodiment according to FIG. 6E has the further advantage that the first surface that can be equipped with the component BE largely consists of the main body GK, which has a good reflectivity. If an LED is applied as component BE, then the light emission thereof is improved by virtue of the higher reflection of the main body, which is largely exposed at the top side. A planar installation location for the component BE, e.g. for an LED, is also obtained as a result. Moreover, a good thermal contact between component and main body is thus ensured.

LIST OF REFERENCE SIGNS

BT Component carrier
GK Ceramic main body
O1,O2 First and second surfaces
AF Electrical terminal pads
EP1 First electrode pair
EP2 Second electrode pair
VS Varistor layer
DK Plated-through hole
OS Solderable surface layer (solderable metal layer)
IE Internal electrode
PS Passivation layer
GF Green film
AK Terminal contacts
FS Prelaminated stack of a plurality of green films
VM Connection means
ZK Zinc oxide grains
ST Structuring tool

The invention claimed is:

1. A component carrier comprising—a ceramic main body having electrical terminal pads on a first surface and a first electrode pair on a second surface, wherein electrical terminal pads and first electrode pair are connected to one another via plated-through holes, comprising—a varistor layer laminated above the first electrode pair, and comprising—a second electrode pair, which is applied above the varistor layer and is electrically connected in parallel with the first electrode pair, wherein the varistor layer is laterally dimensioned such that it is circumferentially spaced apart from the edges of the component carrier, wherein a passivation layer is arranged above the varistor layer and the second electrode pair such that the varistor layer is enclosed on all sides and completely between the ceramic main body, the second electrode pair and the passivation layer and only terminal contacts remain free of and not covered by the second electrode pair, and wherein the passivation layer includes glass or a polymer.

2. The component carrier according to claim 1, wherein the second electrode pair comprises a solderable material or is provided with a solderable surface layer.

3. The component carrier according to claim 1, wherein the main body comprises aluminum nitride.

4. The component carrier according to claim 1, wherein at least the second electrode pair comprises a copper-containing material.

5. The component carrier according to claim 1, wherein at least one internal electrode is arranged between first and second electrode pairs, said at least one internal electrode being embedded into the varistor layer and being electrically floating or electrically connected to a respective electrode of the first electrode pair.

6. A method for producing a component carrier comprising the following steps:

providing a monolithic ceramic main body, providing plated-through holes through the main body, printing electrical terminal pads on a first surface of the main body, printing a first electrode pair on the second surface, laminating a green film or a preformed stack of green films over the whole area above the first electrode pair on the ceramic main body, said green film being able to be converted into a varistor layer by sintering, structuring the green film such that a circumferential marginal region of the second surface of the main body is also exposed besides an access to the first electrode pair, sintering the green film and converting into the varistor layer, printing a second electrode pair onto the varistor layer and the exposed region of the first electrode pair such that first and second electrode pairs are electrically interconnected and an overlap of an electrode of the first electrode pair with the opposite electrode of the second electrode pair jointly defines an active varistor region situated therebetween.

7. The method according to claim 6, wherein one or a plurality of metallizations, selected from terminal pads, first electrode pair and second electrode pair, is produced by printing a paste containing Cu and glass portions, which has a solderable surface after firing.

8. The method according to claim 6, wherein the laminated green film is structured with the aid of a laser.

9. The method according to claim 6, wherein laminating the green film comprises laminating a prelaminated stack of a plurality of green films, wherein at least one internal electrode printed onto a green film is integrated in the stack.

10. The method according to claim 6, wherein the internal electrode is printed in a structured fashion and does not extend over the entire varistor layer, wherein the green film, after laminating, is structured by material removal such that at least one internal electrode intersects one of the exposed edges of the green film, wherein, after printing the second electrode pair, one of the electrodes thereof electrically contacts the internal electrode.

11. The method according to claim 6, wherein, after laminating the green film, before or after printing the second electrode pair, a passivation layer is applied and structured such that in the first case only the surface region provided for the second electrode pair remains free of the passivation layer, or wherein in the second case the printed second electrode pair remains free only in a region in which solderable terminal contacts are subsequently produced by reinforcement of the second electrode pair.

12. The method according to claim 6, wherein after laminating the green film, after printing the second electrode pair, a passivation layer is applied and structured, wherein the printed second electrode pair remains free only in a region in which solderable terminal contacts are subsequently produced by reinforcement of the second electrode pair, wherein the reinforcement is effected by electrodeposition of a solderable metal layer onto the exposed region of the second electrode pair.

13. The method according to claim 6, wherein a large-area main body is provided which is able to be singulated into a multiplicity of component carriers, wherein the large-area main body, after the completion of the second electrode pair or the solderable terminal contacts, is singulated into the multiplicity of component carriers by separation of the main body, wherein the separation of the main body is effected exclusively in the marginal region and at a distance from the respective edge of the varistor layer.

14. A method for producing a component carrier comprising the following steps:

providing a monolithic ceramic main body, providing plated-through holes through the main body, printing electrical terminal pads on a first surface of the main body, printing a first electrode pair on the second surface, laminating a green film or a preformed stack of green films over the whole area above the first electrode pair on the ceramic main body, said green film being able to be converted into a varistor layer by sintering, structuring the green film such that a circumferential marginal region of the second surface of the main body is also exposed besides an access to the first electrode pair, sintering the green film and converting into the varistor layer, printing a second electrode pair onto the varistor layer and the exposed region of the first electrode pair such that first and second electrode pairs are electrically interconnected and an overlap of an electrode of the first electrode pair with the opposite electrode of the second electrode pair jointly defines an active varistor region situated therebetween, wherein a passivation layer is applied such that the varistor layer is enclosed on all sides and completely between the ceramic main body, the second electrode pair and the passivation layer.

* * * * *